US006232716B1

(12) United States Patent
Ok et al.

(10) Patent No.: US 6,232,716 B1
(45) Date of Patent: May 15, 2001

(54) AC-TYPE PLASMA DISPLAY PANEL USING SINGLE SUBSTRATE AND METHOD FOR MANUFACTURING THEREOF

(75) Inventors: Do Young Ok, Kyoungki-do; Deuk Soo Pyun, Seoul, both of (KR)

(73) Assignee: Hyundai Electronics Industries Co., Ltd., Kyoungki-do (KR)

( * ) Notice: Subject to any disclaimer, the term of this patent is extended or adjusted under 35 U.S.C. 154(b) by 0 days.

(21) Appl. No.: 09/141,383

(22) Filed: Aug. 27, 1998

(30) Foreign Application Priority Data

Aug. 30, 1997 (KR) ..... 97-44898

(51) Int. Cl.[7] ..... H01J 17/49
(52) U.S. Cl. ..... 313/582; 313/584; 313/586
(58) Field of Search ..... 313/582, 583, 313/584, 585, 586, 587; 445/24

(56) References Cited

U.S. PATENT DOCUMENTS 3,942,061 * 3/1976 Van Esdonk et al. ..... 313/582
5,209,688 5/1993 Nishigaki et al. ..... 445/24
5,260,624 11/1993 Kim et al. ..... 313/485
5,557,168 * 9/1996 Nakajima et al. ..... 313/586
5,757,131 * 5/1998 Tsuchiya ..... 313/582
5,939,828 * 8/1999 Matsuzaki et al. ..... 313/584
6,005,345 * 12/1999 Choi et al. ..... 313/582

* cited by examiner

*Primary Examiner*—Vip Patel
*Assistant Examiner*—Joseph Williams
(74) *Attorney, Agent, or Firm*—Selitto & Associates, P.C.

(57) ABSTRACT

A plasma display panel comprising a transparent substrate having a first part, a second part and a third part, said second part located between said first part and said third part, a first electrode formed on the first part, a first dielectric layer formed on an entire surface of the transparent substrate with the first electrode, a fluorescent material coated on the first dielectric layer located over the second part, a second electrode vertically spaced from the first dielectric layer and having a prominence toward the first dielectric layer positioned on the third part, the second dielectric layer orthogonal to the first electrode, a third electrode formed on the second electrode positioned on the first electrode, a second dielectric layer vertically spaced from the first dielectric layer and formed under the second electrode including the prominence, the second dielectric layer contacted with the first dielectric layer formed in the third part, and a third dielectric layer formed on the second electrode including the third electrode.

21 Claims, 7 Drawing Sheets

AC-TYPE PLASMA DISPLAY PANEL USING SINGLE SUBSTRATE AND METHOD FOR MANUFACTURING THEREOF

BACKGROUND

The present invention relates to a technique of plasma display panel(PDP) and in particular to a PDP having an electrode and a barrier rib, both formed by the photolithography and also having increased excitation area of a fluorescent material, and a method thereof.

In general, PDP is display device using gas discharge, and the PDP is thinner and lighter than the cathode ray tube using electron gun. Also, the PDP can be manufactured in enormous scale and has been highlighted as a future display device.

FIG. 1 illustrates a cross sectional view of an AC-type PDP. The PDP has a plurality of discharging cells, each of them can discharge independently. Each discharging cell 10 comprises a back substrate 1, an address electrode 2 formed on the back substrate 1, a discharge maintenance electrode 6 formed on the front substrate 5 in a stripe form and a protective layer 8 formed on the entire surface of the front substrate with the discharge maintenance electrode 6. The barrier rib 3 for preventing the crosstalk between pixels, defines a unit discharge cell together with the address electrode 2 and the discharge maintenance electrode 6 located on the back substrate 1 and the front substrate 5 respectively. On the back substrate 1 having the address electrode 2 in the discharging cell is coated a fluorescent material 4. Between the fluorescent material 4 and the protective layer 8 is provide a discharging space 9. The discharging space 9 is filled with a discharging gas such as Ne, Ar or Xe.

If a given voltage is applied to the discharge maintenance electrode of the PDP, ultraviolet rays are generated from the discharging gas of the discharging space 9 and the fluorescent material is excited owing to the ultraviolet rays. Here, a visible light of red, blue or green is radiated according to an optical feature of the fluorescent material, thereby displaying a signal.

However, the barrier rib 3 is formed by a multiple printing method, so it is difficult to obtain the barrier rib having a uniform height and width. And luminance and resolution of the PDP are degraded. In addition, the PDP is produced by using a pair of transparent substrates in which the address electrode and the discharge maintenance electrode are formed on the respective substrates by independent processes and then two substrates are attached to each other. In case where the misalign occurs during the attaching process, an arrangement relation between the address electrode and the discharge maintenance electrode is shifted compared with the normal case, thereby reducing the luminance efficient of the discharging cell.

SUMMARY

Accordingly, an aim of a present invention is to provide a PDP having a uniform height and width and a method for manufacturing the same.

Another aim of the present invention is to prevent a misalign generated during production of the PDP by establishing a discharging cell using only one transparent substrate.

Further aim of the present invention is to enhance brightness and luminance efficient of the PDP device by increasing a discharging area of the cell and an excitation area of a fluorescent material.

In order to accomplish the aims of the present invention, one substrate is patterned to three parts. The fluorescent material is coated on a middle part thereof which is provided with at least one prominence and depression, thereby increasing the excitation area of the fluorescent material. The address electrode and the discharge maintenance electrode are formed on the same one substrate, so that the misalign generated when using two substrates is fundamentally removed. Further, the discharge maintenance electrode has a prominence which is connected to a part of the substrate on which the address electrode covered with a dielectric layer is not formed. The prominence of the discharge maintenance electrode serves as the barrier rib of a conventional PDP and is formed by using photolithography. Thus, the barrier rib of the present invention has a uniform height and width. In detail, a PDP comprises single transparent substrate. The substrate has a first part, a second part and a third part. The PDP has a first electrode, i.e. address electrode formed on the first part and a first dielectric layer formed on the entire transparent substrate with the first electrode. The second part is located between the first and the third parts, and comprises at least one prominence and depression, and height of the prominence and depression is lower than those of the first part and the third part. A fluorescent material is coated on the first dielectric layer located on the second part. A second electrode having prominences is positioned on the first dielectric layer portion of the third part, and is connecting the prominences each other, and is extended to be orthogonal to the first electrode. A second dielectric layer is formed on a bottom of the second electrode. A third electrode is formed on the second electrode positioned on the first electrode. A third dielectric layer is formed on the second electrode including the third electrode. An ultraviolet shielding layer is disposed between the prominence of the second electrode and adjacent another prominence thereof in an extension direction of the first electrode. Herein, the ultraviolet shielding layer is a metal layer, an insulating layer, an organic resin or an inorganic resin. So as to manufacture such a PDP, first, a transparent substrate is prepared. A first electrode is formed on a predetermined part of the substrate. The transparent substrate is defined by using a photoresist mask pattern into a first part having a prominence, a third part being separated from the first part and a second part between the first and third parts, and the second part with a prominence and a depression has a height lower than those of the first and third parts. Herein, said first electrode is formed on the first part. A first dielectric layer is formed on the entire transparent substrate including the first electrode. A fluorescent material is coated on the second part. A sacrificial layer having an even surface is formed on the resultant. A contact hole exposing the first dielectric layer positioned over the third part is formed in the sacrificial layer. A second dielectric layer is formed on both inner sides and a bottom of the contact hole and on the sacrificial layer. A second electrode is formed on the second dielectric layer with completely filling the contact hole and being extended orthogonal to the first electrode. A third electrode is formed on the second electrode positioned on the first electrode. A third dielectric layer is formed on the second electrode including the third electrode. A part of the second dielectric layer, the third dielectric layer and the sacrificial layer are removed so as to define a discharging space. The sacrificial layer is made of polyimide. A seed layer for an electrode is formed on the second dielectric layer. A photoresist pattern is formed on said seed layer. An exposed part of the seed layer part is electroplated by the photoresist pattern, thereby forming an electroplating layer. Herein, an ultraviolet shielding layer is further formed in a space between the prominence of the second electrode and adjacent another prominence thereof in an extension direction of the first electrode. The ultraviolet shielding layer is a metal layer, an insulating layer, an organic resin or an inorganic resin.

BRIEF DESCRIPTION OF THE ATTACHED DRAWINGS

FIG. 1 is a cross sectional view of a PDP according to the conventional technology.

FIGS. 2A~2I are cross-sectional views for illustrating sequential manufacturing processes of the PDP according to the present invention.

DESCRIPTION OF THE EMBODIMENT

With reference to FIGS. 2A~2I, FIG. 3 and FIG. 4, the embodiment of the present invention will be explained in detail.

Figure 1:
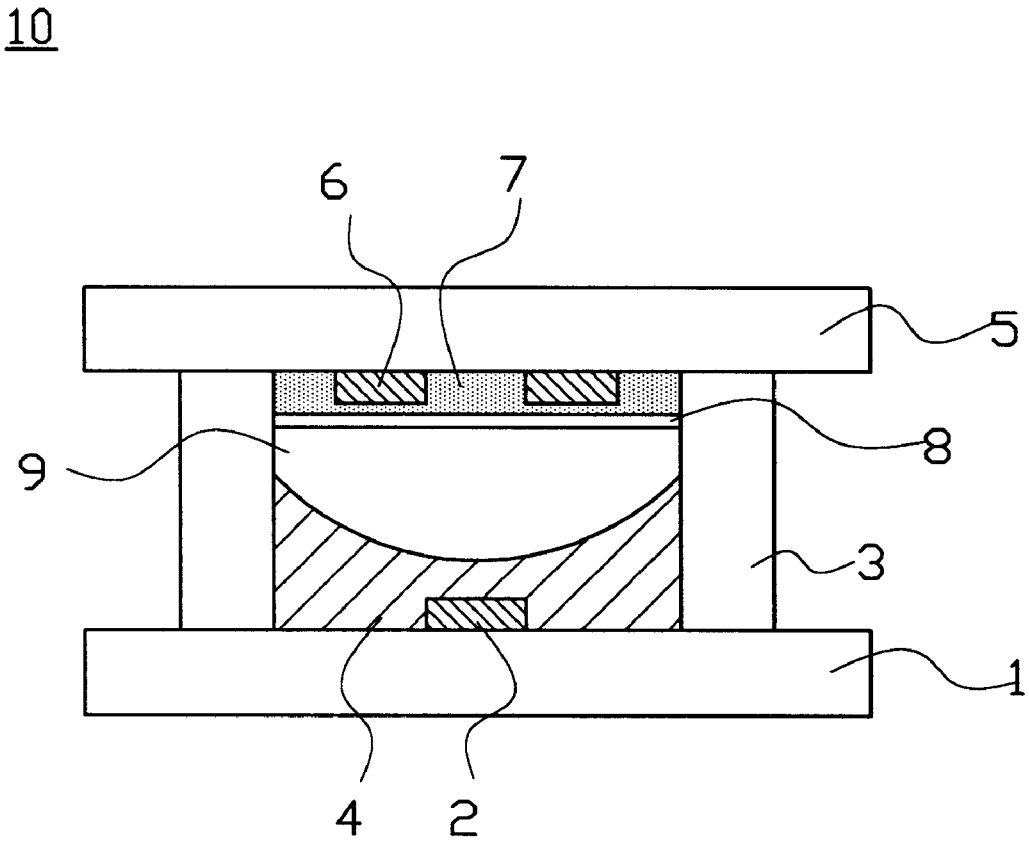
FIG. 1 (PRIOR ART)
Figure 2A:
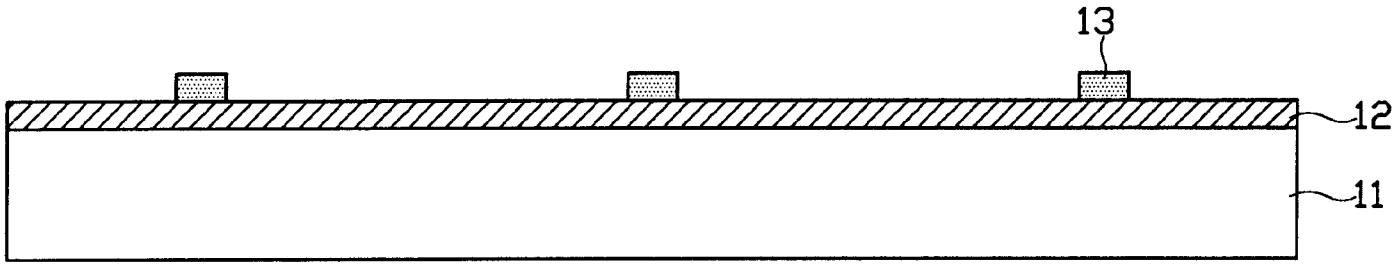
Figure 2B:
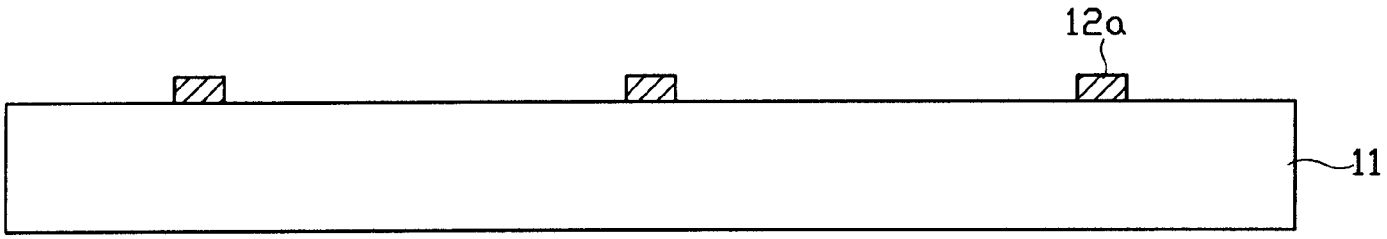

In FIG. 2A, on the entire transparent substrate 11 is evenly coated with an address electrode material, forming a material layer 12. Sequentially, a first photoresist pattern 13 is formed on the material layer 12 using a photolithography process. In FIG. 2B, the material layer 12 is patterned, forming the address electrode 12*a* and then the first photoresist pattern 13 served as an etch mask is removed.

Figure 2C:
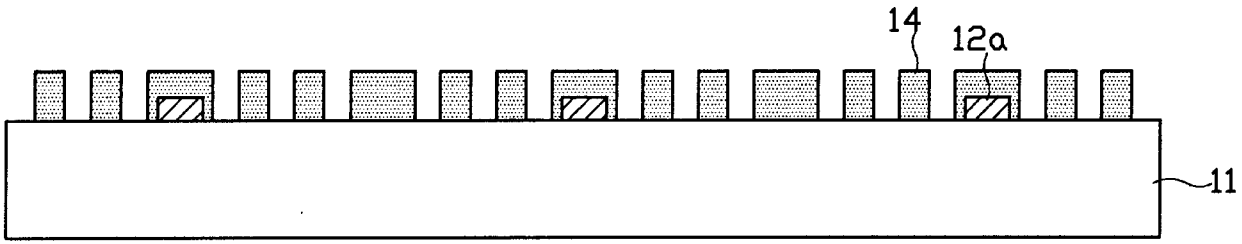
Figure 2D:
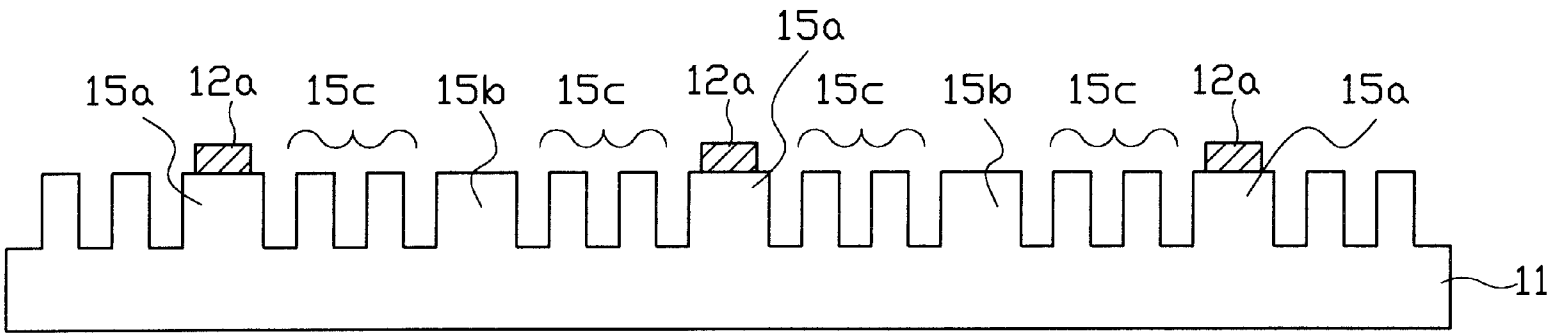

In FIG. 2C, a photoresist is coated on the entire substrate 11 wherein the address electrode 12*a* is formed and then patterned, forming a second photoresist pattern 14 exposing the portion of the substrate 11. In FIG. 2D, the exposed portion of the substrate 11 is firstly wet- or dry-etched, defining the substrate into three parts. Between the first part 15*a* and the third part 15*b* is formed the second part 15*c*. The second part 15*c* is formed by etching the portion of the substrate and has at least one prominence and one depression. On the surface of the first part 15*a* is disposed an address electrode and on the surface if the third part 15*b* there is no address electrode. Both the first part 15*a* and the third part 15*b* have the same height and width. The more the number of the prominence and the depression of the second electrode 15*b* is, the more the amount of the coating area of the fluorescent material increases. As a result, the luminance efficient of the PDP is even more increased.

Figure 2E:
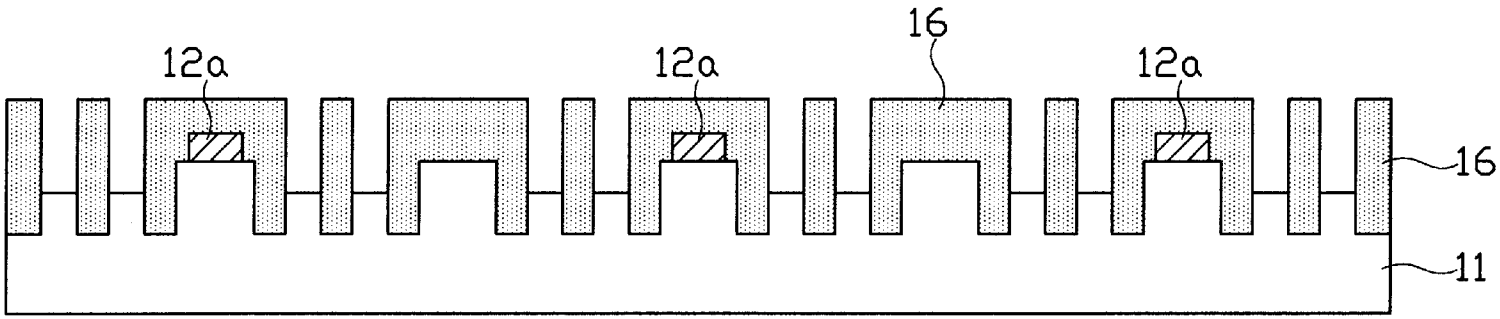

In FIG. 2E, a third photoresist pattern 16 is formed covering the first part 15*a* and the third part 15*b* and a portion of the second part 15*c*. Using the third photoresist pattern 16 as an etching mask, the substrate of the second part 15*c* is wet- or dry-etched. Accordingly, height of the prominence and the depression of the second part 15*c* is lower than those of the first part 15*a* and the third part 15*b*. In the sequential process, a fluorescent material is coated on the second part 15*c*.

Figure 2F:
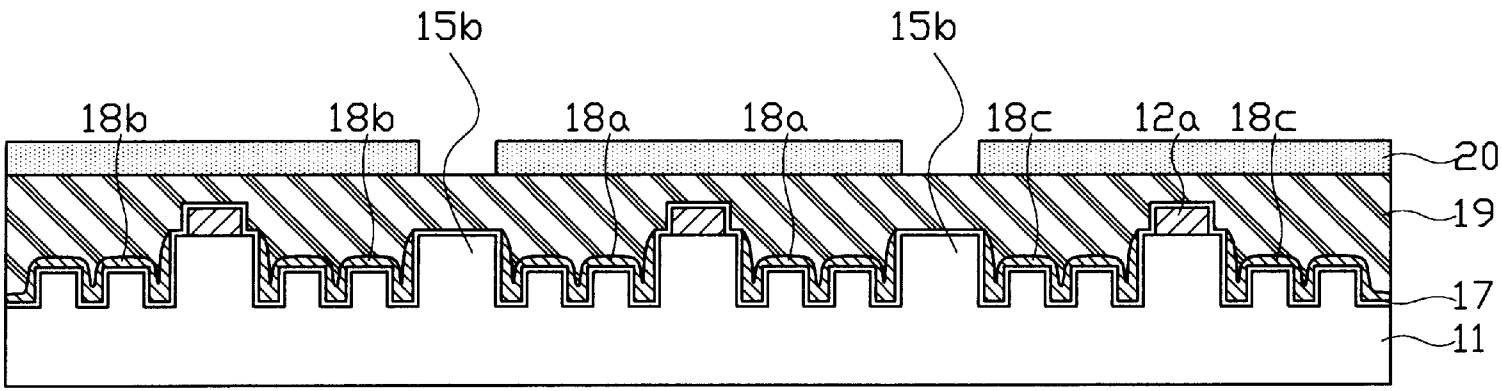

Referring to FIG. 2F, after removing the third photoresist pattern 16, a first dielectric layer 17 is formed on the entire substrate 11 including the address electrode 12*a* in order to prevent a damage of the address electrode 12*a* caused by ion sputtering during the discharging. A red fluorescent material 18*a*, a blue fluorescent material 18*b* and a green fluorescent material 18*c* are coated on the surface of the first dielectric layer 17. The fluorescent material in each discharging cell is one selected from the red, blue or green fluorescent material.

Continuously, a sacrificial layer 19 of polyimide is formed on the surface of the resultant. On the sacrificial layer 19 is formed a fourth photoresist pattern 20 exposing only a portion corresponding to the third part 15*b* of the substrate 11 among the sacrificial layer 19.

Figure 2G:
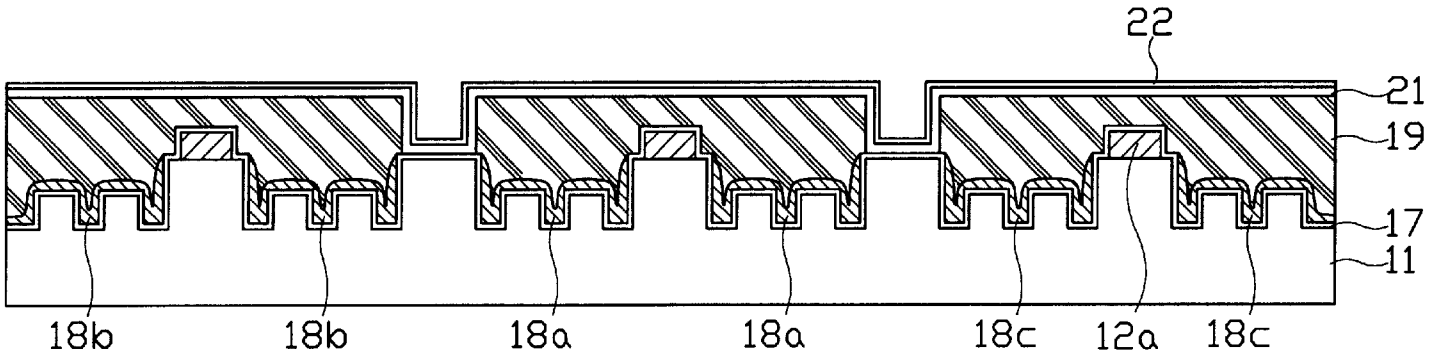

In FIG. 2G, the exposed sacrificial layer 19 is etched using the fourth photoresist pattern 20 as a mask, forming a contact hole exposing the first dielectric layer 17 positioned on the third part 15*b* of the substrate 11. Thereafter, the fourth photoresist pattern 20 is removed. A second dielectric layer 21 and a seed layer 22 for forming a discharge maintenance electrode are successively formed on the inner sides and bottom surface of the contact hole and the top surface of the sacrificial layer 19.

Figure 2H:
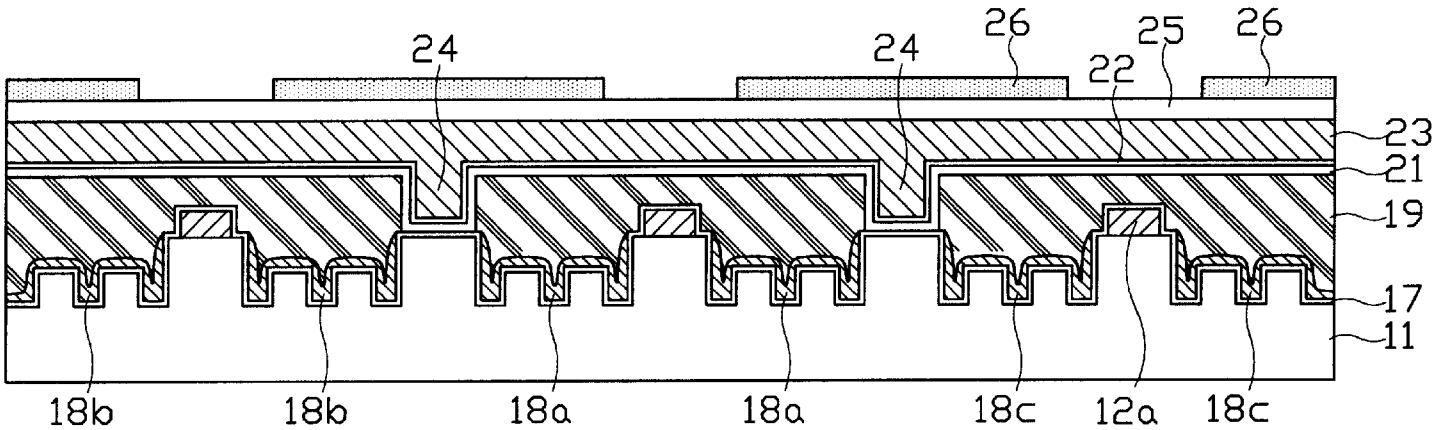

In FIG. 2H, the discharge maintenance electrode 23 is formed at a portion of the seed layer 22 using an electroplating method. That is, a fifth photoresist pattern(not shown) is coated on the seed layer 22 and then the electroplating is performed. Thus, the discharge maintenance electrode is formed on the portion on which the fifth photoresist pattern is not formed. The discharge maintenance electrode is orthogonal to the address electrode 12*a* and has a stripe form. The discharge maintenance electrode comprises a post 24 completely filling the contact hole. The post 24 surrounded by the second dielectric layer 21, together with the third part 15*b* covered with the first dielectric layer 17 serves the barrier rib defining the unit discharging cell. Thereafter, Indium Tin Oxide(ITO) electrode material layer 25 and a sixth photoresist pattern 26 exposing a portion corresponding to the address electrode are sequentially formed on the discharge maintenance electrode 23.

Figure 2I:
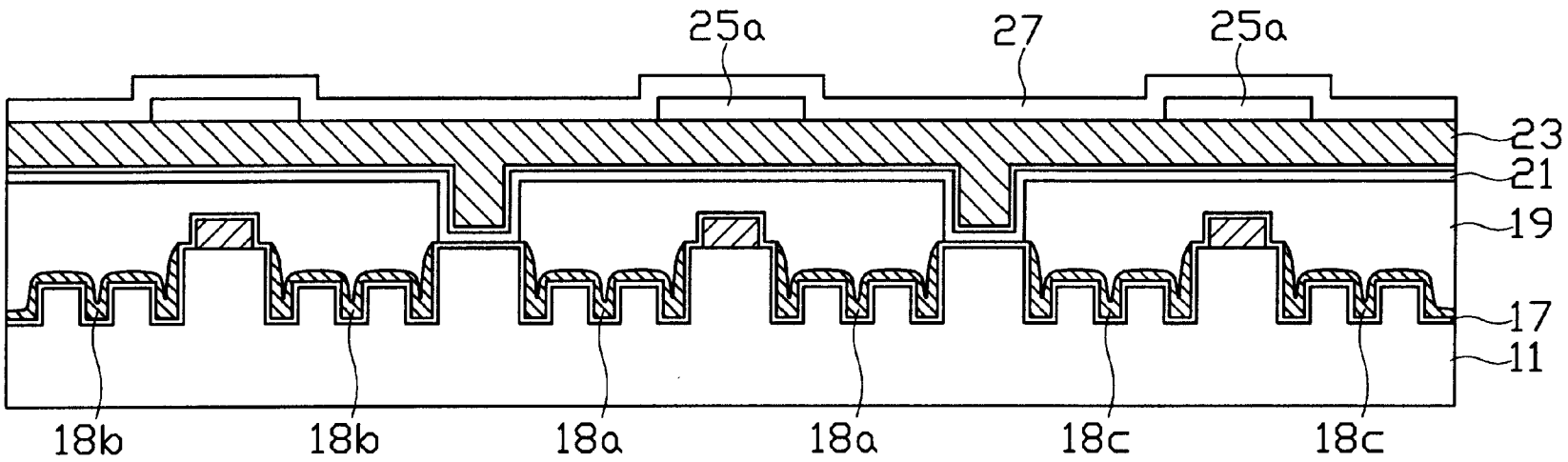

In FIG. 2I, the ITO electrode material layer 25 is etched using the sixth photoresist pattern 26, forming an ITO electrode 25*a* on the discharge maintenance electrode 23 positioned on the address electrode 12*a*. Then, the sixth photoresist pattern 26 is removed and a third dielectric layer 27 is formed on the discharge maintenance electrode 23 including the ITO electrode 25*a*.

Figure 3:
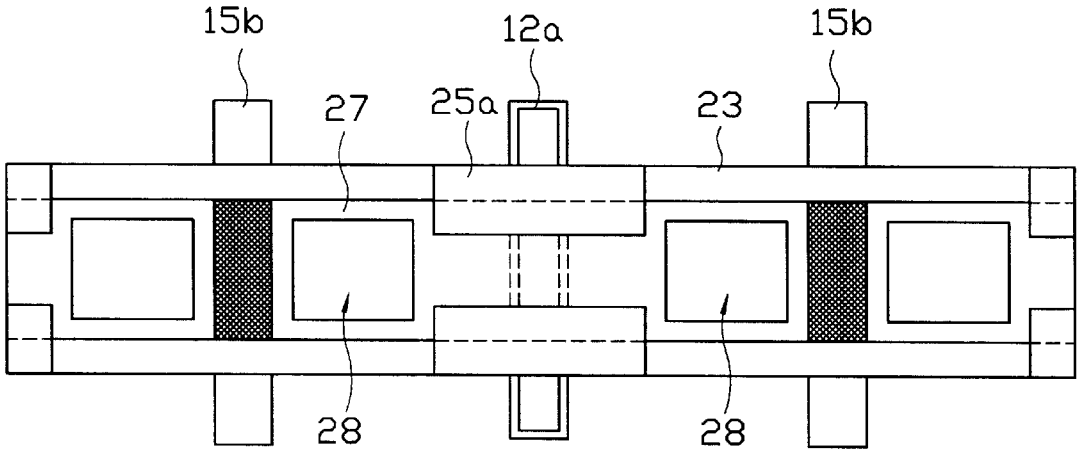
FIG. 3 is a plane view of the PDP according to the present invention.
Figure 4:
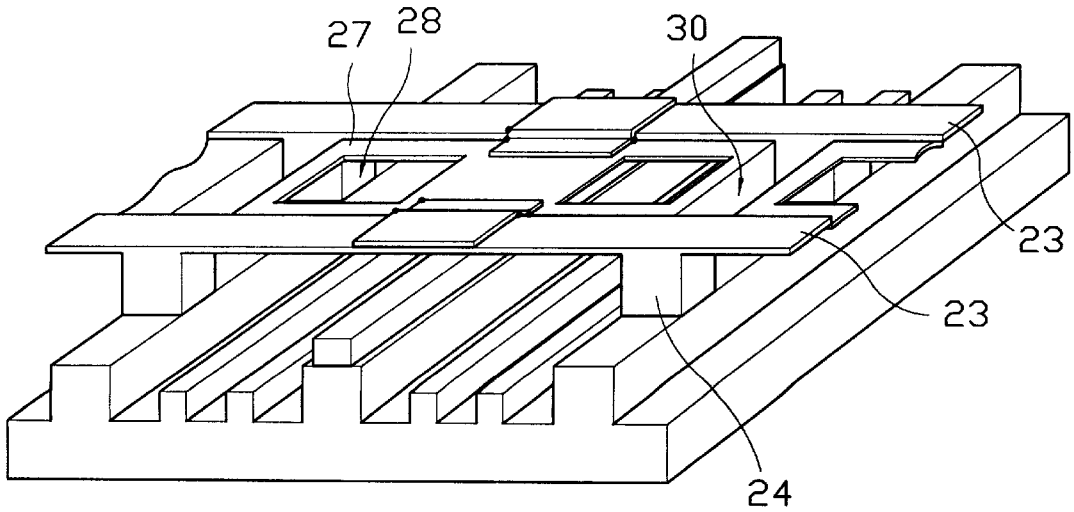
FIG. 4 is a cross-sectional view of the PDP according to the present invention.

Then, though not shown, the third dielectric layer is patterned for selectively etching the sacrificial layer 19, the portion of the third dielectric layer 27 and the second dielectric layer 21 are removed by wet etch or dry etch, and then the sacrificial layer is removed, providing the discharging space(see: numeral 28 in FIGS. 3 and 4).

FIG. 3 is a plane view of the PDP according to the present invention and FIG. 4 is a cross-sectional view of the PDP according to the present invention. The same components in FIGS. 3 and 4 are referred by the same reference numerals as used in FIGS. 2A~2I.

On the first part of the substrate having the address electrode 12*a* is disposed the sacrificial layer(not shown). On the address electrode 12*a*, is positioned the discharge maintenance electrode 23 particular to the address electrode 12*a*. Over the cross section part of the address electrode 12*a* and the discharge maintenance electrode 23 is disposed the ITO electrode 25*a* having a dot shape.

The third part 15*b* of the substrate having no address electrode 12*a* and the discharge maintenance electrode 23 are connected through the post 24 provided with the discharge maintenance electrode 23. Such a post 24 together with the third part 15*b* of the substrate plays a role of the barrier rib. The third dielectric layer 27 is formed on the entire surface of the resultant. The portions of the third and the second dielectric layers are removed and then the portion of the sacrificial layer is removed, thus producing the discharging space 28.

Referring to FIG. 4, between the posts 24 disposed in the extension direction of the address electrode is formed a groove 30. In case where the second and the third dielectric layer have feature passing the ultraviolet rays, light interference could be happened between adjacent discharging cells. Accordingly, in order to block light interference between adjacent discharging cells, the grooves 30 is filled with a metal, an insulating material having an ultraviolet shielding capability, or an organic or inorganic resin. The filling process is carried out before removing the second dielectric layer and the third dielectric layer using photolithography process. The post including the groove filled with the ultraviolet shielding layer corresponds to the barrier rib of the PDP.

In detail, a photoresist is coated on the surface of the resultant and then is exposed and developed, forming a photoresist pattern exposing the groove 30. The groove 30 is filled with a metal or an insulating material having an ultraviolet shielding capability. After removing the photoresist pattern, the second and the third dielectric layers and the sacrificial layer are removed. In case of using resin, an organic or inorganic resin capable of shielding the ultraviolet rays is coated on the surface of the resultant with completely filling the groove 30 and then resin coated on a region excluding the groove 30 is removed. Thereafter the third dielectric layer 27, the second dielectric layer 21 and the sacrificial layer are removed.

The PDP according to the spirit of the present invention may further comprise another transparent substrate disposed on the upper part thereof, for physically protecting the discharging cell. However, a pair of substrates, including the additional substrate of the present invention have different function from a pair of transparent substrates employed in the conventional art. In the present invention, on single substrate are formed the address electrode and the discharge maintenance electrode by which both the discharging cell is established. Thus, is prevented the misalign generated during the attachment of those substrates of the PDP manufactured according to the conventional art.

As described above, because the barrier rib is formed using the photolithography method in the PDP and the method thereof, the accuracy of manufacturing the PDP is enhanced. In addition, the size of the barrier rib can be minimized up to the limit of the photolithography process, so that the scale reduction of the cell is possible and thus the resolution of the PDP is increased. Also, the portion on which the fluorescent material is coated has one prominence and depression, so discharging area of the discharging cell and the excitation are of the fluorescent material are increased, which results in that the brightness of the PDP is elevated. As another feature of the present invention, because the discharging cell is made by using single substrate, there is no misalign generated at using two substrate. Thus, the reduction of the yield is suppressed and the cost is cut down.

Although only a preferred embodiment of the present invention has been discussed and illustrated, various modification can be carried out without departing from the spirit of the present invention as defined by the claims hereinafter.

What is claimed is:

1. A plasma display panel comprising:

a transparent substrate having a first part, a second part and a third part, said second part being located between said first part and said third part and including at least one prominence and a depression;

a first electrode formed on the first part;

a first dielectric layer formed on the entire transparent substrate including the first electrode;

a fluorescent material coated on the first dielectric layer located on the second part;

a second electrode vertically spaced from the first dielectric layer and having a prominence projecting toward the first dielectric layer positioned on the third part, the second electrode extending orthogonal to the first electrode;

a third electrode formed on the second electrode positioned above the first electrode;

a second dielectric layer vertically spaced from the first dielectric layer and formed under the second electrode including the prominence of the second electrode, the second dielectric layer being in contact with the first dielectric layer formed on the third part; and a third dielectric layer formed on the second electrode including the third electrode.

2. The plasma display panel according to claim 1, wherein the prominence and depression of the second part have heights smaller than those of the first part and the third part.

3. The plasma display panel according to claim 1, wherein the fluorescent material is a material selected from the group consisting of red, green and blue fluorescent materials.

4. The plasma display panel according to claim 1, wherein the first electrode is an address electrode, wherein the second electrode is a discharge maintenance electrode; and wherein the third electrode is an indium tin oxide electrode.

5. The plasma display panel according to claim 1, further comprising an ultraviolet shielding layer extending between the prominence of the second electrode and an adjacent prominence of the second electrode along a direction in which the first electrode extends.

6. The plasma display panel according to claim 5, wherein said ultraviolet shielding layer is a metal layer.

7. The plasma display panel according to claim 5, wherein said ultraviolet shielding layer is an insulating layer.

8. The plasma display panel according to claim 5, wherein said ultraviolet shielding layer is organic resin or inorganic resin.

9. A method for manufacturing a plasma display panel, comprising the steps of:

preparing a transparent substrate;

forming a first electrode on a predetermined part of the transparent substrate;

defining the transparent substrate into a first part, a second part and a third part, the second part being located between the first part and the third part and including at least one prominence and a depression, wherein the first electrode is formed on the first part;

forming a first dielectric layer on the entire transparent substrate including the first electrode;

coating a fluorescent material on the second part;

forming a sacrificial layer on the transparent substrate;

forming a contact hole in the sacrificial layer for exposing the first dielectric layer positioned on the third part;

forming a second dielectric layer on inner sides and a bottom of the contact hole and on the sacrificial layer, forming a second electrode on the second dielectric layer, completely filling the contact hole, said second electrode extending orthogonal to the first electrode;

forming a third electrode on the second electrode positioned above the first electrode;

forming a third dielectric layer on the second electrode including the third electrode; and removing a part of the second dielectric layer, the third dielectric layer and the sacrificial layer so as to define a discharging space.

10. The method according to claim 9, wherein said first part and the third part have the same height and width.

11. The method according to claim 9, wherein the prominence and depression have heights smaller than those of the first part and the third part.

12. The method according to claim 9, wherein the fluorescent material is a material selected from the group consisting of red, green and blue fluorescent materials.

13. The method according to claim 9, wherein said sacrificial layer is made from polyimide.

14. The method according to claim 9, wherein the step of forming the second electrode comprises the steps of:

forming a seed layer for an electrode on the second dielectric layer;

forming a photoresist pattern on said seed layer; and electroplating an exposed part of the seed layer by the photoresist pattern, thereby forming an electroplating layer.

15. The method according to claim 9, further comprising the step of forming an ultraviolet shielding layer in a space formed between a prominence of the second electrode and an adjacent prominence of the second electrode along a direction in which the first electrode extends, the step of forming the ultraviolet shielding layer being performed prior to the performance of the removing step.

16. The method according to claim 15, wherein said ultraviolet shielding layer is a metal layer.

17. The method according to claim 15, wherein said ultraviolet shielding layer is an insulating layer.

18. The method according to claim 15, wherein said ultraviolet shielding layer is organic resin or inorganic resin.

19. The method according to claim 15, wherein the first electrode is an address electrode; wherein the second electrode is a discharge maintenance electrode; and wherein the third electrode is an indium tin oxide electrode.

20. A plasma display panel comprising:

a transparent substrate having a first part, a second part and a third part, the second part being located between the first part and the third part and including at least one prominence and a depression;

a first electrode formed on the first part;

a first dielectric layer formed on the entire transparent substrate including the first electrode;

a fluorescent material coated on the first dielectric layer located on the second part;

a second electrode having prominences positioned on a portion of the first dielectric layer located on the third part, the second electrode connecting the prominences of the second electrode to each other and extending orthogonal to the first electrode;

a second dielectric layer formed on a bottom of the second electrode;

a third electrode formed on the second electrode positioned above the first electrode; and a third dielectric layer formed on the second electrode including the third electrode.

21. The method according to claim 9, wherein the sacrificial layer has an even surface.

* * * * *